United States Patent [19]

Wilms

[11] Patent Number: 4,978,228

[45] Date of Patent: Dec. 18, 1990

[54] MIXING BIN

[75] Inventor: Harald Wilms, Eriskirch, Fed. Rep. of Germany

[73] Assignee: Zeppelin-Metallwerke GmbH, Fed. Rep. of Germany

[21] Appl. No.: 394,925

[22] Filed: Aug. 17, 1989

[30] Foreign Application Priority Data

Aug. 26, 1988 [DE] Fed. Rep. of Germany ..... 3829055

[51] Int. Cl.[5] ..... B01F 5/00; B01F 5/24

[52] U.S. Cl. ..... 366/138; 366/177; 366/337; 366/341

[58] Field of Search ..... 366/101, 107, 138, 136, 366/137, 140, 159, 163, 177, 178, 179, 180, 181, 182, 189, 191, 192, 193, 340, 341, 336, 337; 406/64; 414/220, 267, 268; 222/459, 564, 478, 464, 1; 138/38, 40, 42; 137/896

[56] References Cited

U.S. PATENT DOCUMENTS

| | | | |
|---|---|---|---|
| 517,158 | 3/1984 | Hartmann | 366/177 |
| 694,575 | 3/1902 | Ransome | 366/336 |
| 1,496,896 | 6/1924 | Laffoon | 366/337 |
| 2,345,554 | 4/1944 | Burdett | 366/337 |
| 2,455,572 | 12/1948 | Evans | 366/336 |
| 2,907,501 | 10/1959 | Laird | 366/337 |
| 3,094,243 | 6/1963 | Haugen | 366/336 |
| 3,216,629 | 11/1965 | Goins | 366/159 |
| 3,361,413 | 1/1968 | Heyl . | |
| 3,539,154 | 11/1970 | Goins | 366/178 |
| 4,384,789 | 5/1983 | Avery, Jr. | 366/341 |
| 4,822,173 | 4/1989 | Paul | 366/101 |

FOREIGN PATENT DOCUMENTS

| | | | |
|---|---|---|---|
| 29575 | 10/1930 | Australia | 366/337 |
| 3208499 | 3/1983 | Fed. Rep. of Germany . | |
| 3401687 | 7/1985 | Fed. Rep. of Germany . | |
| 3607485 | 9/1987 | Fed. Rep. of Germany . | |
| 1379212 | 10/1964 | France . | |
| 236154 | 8/1925 | United Kingdom | 366/178 |
| 2187652 | 9/1987 | United Kingdom . | |

*Primary Examiner*—Timothy F. Simone

*Attorney, Agent, or Firm*—Arnold, White & Durkee

[57] ABSTRACT

Described is a mixing bin for mixing bulk goods, particularly by pure gravity flow, comprising a mixing pipe disposed at a substantially central location in an outer container and provided with a plurality of intake ports disposed at different levels for withdrawing bulk goods at different levels from a bulk goods column enclosed by the outer container. All intake ports open into a common interior space of the mixing pipe. A respective deflector baffle projecting into the interior space so as to obturate a part of the cross-sectional area thereof is disposed above each intake port to be passed by the bulk goods flow in the interior space. For improving the result of the mixing operation in a structurally simple manner the invention proposes to vary the size of the part of the cross-sectional area obturated by the deflector baffles disposed at the different levels, the selected size of the obturated part of the cross-sectional area being determined by the amount of the bulk goods to be withdrawn through the associated intake port.

20 Claims, 3 Drawing Sheets

MIXING BIN

DESCRIPTION

Figure 1:
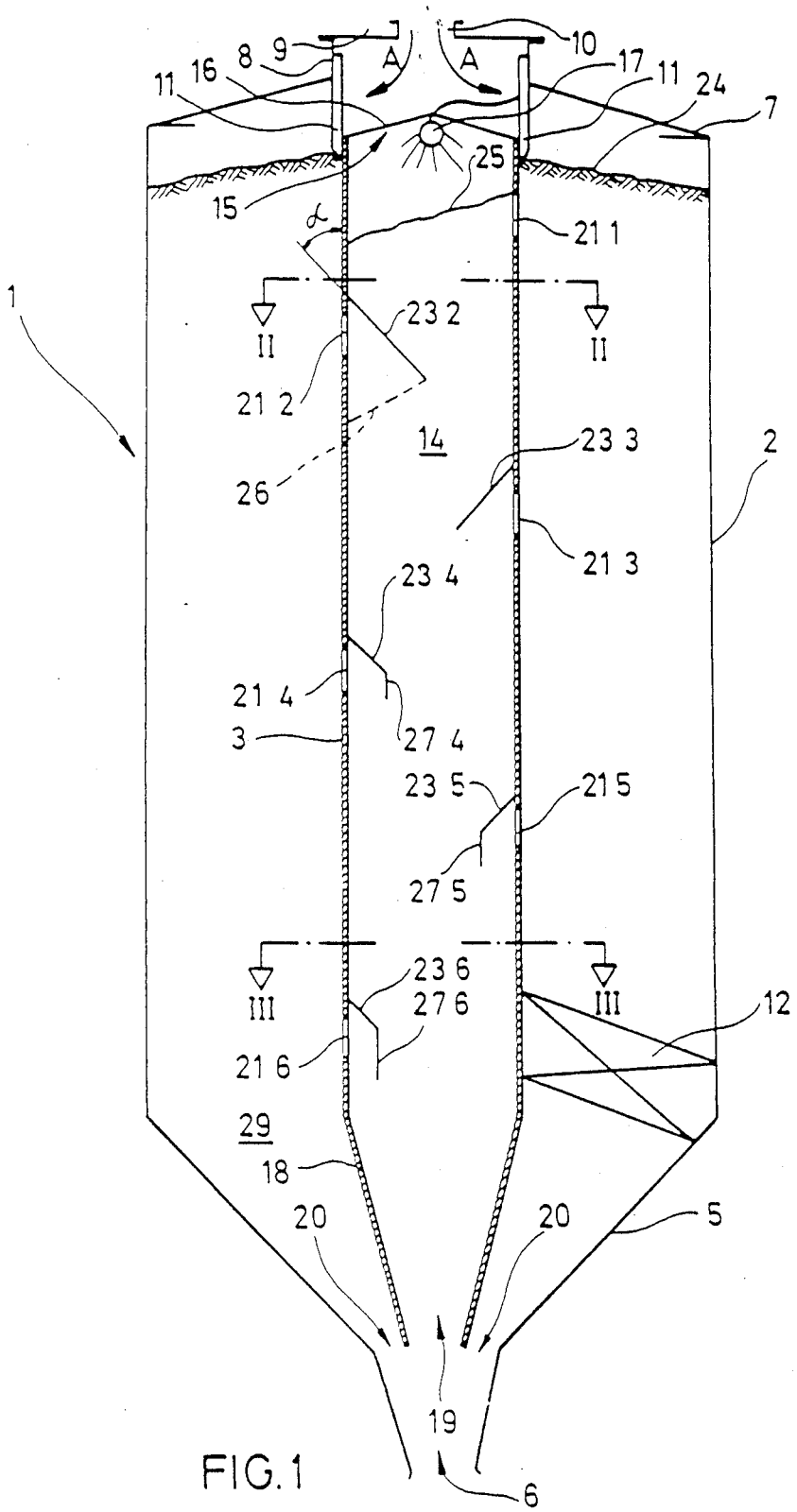

The invention relates to a mixing bin for mixing bulk goods, specifically by pure gravity flow.

A mixing bin of this type is known from GB-A-2,187,652. This known mixing bin is designed for the withdrawal of uniform amounts of bulk goods through intake ports disposed at different levels. In order to achieve this performance, the size of the intake ports of the known mixing bin is varied in accordance with a given equation, so that intake ports disposed at a lower level are smaller than intake ports situated at higher levels. The deflector baffles of all intake ports are of equal size and arranged at substantially the same angle, so that they obturate substantially the same proportion of the cross-sectional area of the interior space of the mixing pipe. In the case of the known mixing bin, the size of each intake port is thus accurately determined. When processing bulk goods having insufficient flow properties there exists the danger, however, of the occurrence of the so-called bridging effect, i.e. under certain circumstances it is possible that particles of the bulk goods to be processed form a self-supporting structure spanning an intake port so as to obstruct the passage of the material therethrough. In the case of vertically extending intake ports it is possible to avoid this bridging effect by suitably increasing the size of the port. In view of the fact, however, that the size of the intake ports is determined by other considerations as in the case of the known mixing bin, it is no longer possible to guard against the possible occurrence of the bridging effect and the resultant obstruction of the passage of the bulk goods from the outer container through the intake ports and into the interior of the mixing pipe by selecting a suitable configuration for the intake ports. This shortcoming may adversely affect the result of the mixing operation.

The prior art has not lacked endeavours aimed at ensuring uniform withdrawal of bulk goods over the height of a mixing bin having a central mixing pipe. A mixing bin of this type is known for instance from FR-A-1,379,212. In this known mixing bin, the inner mixing pipe contains several compartments each of which communicates with the outer container through a respective intake port. The intake ports of the individual compartments are disposed at different levels, so that the bulk goods contained in the outer container can be withdrawn therefrom at different levels. The thus withdrawn bulk goods pass through the interior of the mixing pipe and drop into a funnel together with the bulk goods that have remained in the outer container, and may subsequently be removed from the funnel. The mixing effect of this known mixing bin is rather unsatisfactory, however. On the one hand, the diameter of the mixing pipe must not become too great as compared to the diameter of the outer container, if a mixing effect is to be achieved at all. On the other hand, there remains an empty space over each intake port, the size of these empty spaces increasing as the level of the respective intake ports gets lower. This results in a waste of valuable storage volume. In addition, the manufacture of this known construction is rather expensive, because the individual chambers have to be accurately fitted into the mixing pipe.

Disclosed in U.S. Pat. No. 3,216,629 is a mixing bin particularly designed for pneumatic recirculation of the bulk goods to be mixed. The interior of the container contains a plurality of mixing pipes provided with deflector baffles of different configuration. The mixing pipes are formed with ports disposed at different levels with an outwards or inwards facing deflector baffle extending from a location thereabove. In both cases the deflector baffles for each port of the mixing pipe are of the same size and obturate more than half the cross-sectional area of the mixing pipes, due to the relatively small diameter of the mixing pipes. In an arrangement of this type it has been found that the bulked goods would preferentially tend to pass through the lowermost intake port of each mixing pipe. In addition, mixing bins containing a plurality of relatively thin mixing pipes are rather unsuitable for processing cohesive bulk goods or bulk goods having unsatisfactory flow properties, since the danger of occurrence of the bridging effect at the intake ports and small cross-sectional areas is very serious, and is still further aggravated in the case of this known mixing bin by the great number of deflector baffles disposed vertically above one another and projecting relatively far into the cross-sectional area of the mixing pipes.

Known from DE Pat. No. 3,208,499 is a mixing bin which is allegedly designed so that substantially equal proportions of bulk goods can be withdrawn at different levels. To this purpose the mixing pipe consists of a plurality of funnels disposed above one another with their outlet ports disposed at the level of the inlet port of the respective subjacent funnel. The funnels are substantially of the same size, so that the annular inlet ports for the intake of the bulk goods from the outer container at different levels as well as the circular outlet openings for the passage of the bulk goods in the interior of the mixing pipe are likewise of the same size at all levels. In order to enable this mixing bin to be also employed for processing bulk goods having unsatisfactory flow properties, the annular intake ports leading into the mixing pipe have to be of substantial size. This mixing pipe construction has to be of a very considerable size so as to guard against any bridge-formation over the remaining open spaces. The construction of this mixing pipe is moreover relatively complicated and costly. Finally the obtained mixing effect is not either fully satisfactory, as evident from the fact that an additional pneumatic recirculation is employed for achieving a thorough mixing effect.

It is therefor an object of the present invention to improve a mixing bin of the type defined above in such a manner that the mixing result is controllable in a predetermined manner by using a simple and space-saving construction of the mixing bin.

This object is attained by a mixing bin comprising an outer container having a bottom provided with an outlet and a mixing pipe centrally disposed in the outer container, with the mixing pipe having a plurality of intake ports located at different levels above the outer container bottom for withdrawing bulk goods from a column of bulk goods contained in the outer container. Above each of these intake ports, a deflector baffle projects into the interior of the mixing pipe, obturating a part of the cross-sectional area of the interior space of the mixing pipe. The size of the obturated part of the mixing pipe cross-sectional area is selected according to the amount of the bulk goods desired to be withdrawn through the associated intake port.

The invention is based on applicant's recognition that the amount of the bulk goods passing through any intake port is substantially determined by the size of the part of the cross-sectional area of the mixing pipe obturated by the associated deflector baffle. The use of deflector baffles of different sizes thus permits the proportional mixing rate of the bulk goods withdrawn from different layers of the bulk good column in the outer container to be accurately predetermined and controlled. The invention permits the employ of a single mixing pipe at a substantially central location without any empty spaces reducing the storage capacity of the mixing bin. The construction according to the invention also permits the sizes of the intake ports to be selected with a view to avoiding the occurence of the bridging effect. The size of the intake ports may be determined for a given type of bulk goods and may then be the same over the full length of the mixing pipe to thereby simplify the manufacture of the mixing bin.

When each deflector baffle obturates a part of the cross-sectional area of the mixing pipe calculated by dividing this area by the number of baffles about it plus one, substantially the same proportional amounts of the bulk goods will enter the mixing pipe through all intake ports at all levels of the mixing pipe, resulting in optimum proportional mixing of the bulk goods withdrawn from the mixing pipe.

The downward inclination of the deflector baffles, especially of 20° to 45° is effective to avoid the formation of dead zones.

By providing that a slope surface of the bulk good adjacent each intake port is located below a lowermost edge of the associated intake port, bulk goods descending from higher-level intake ports are restricted from interferring with the passage of bulk goods through a lower-level intake port. Any interference of this kind may be avoided in a particularly simple manner by the provision that the deflector baffle extends in any case to a level below the lowermost edge of the associated intake port as stated in claim 6.

If the deflector baffle has to be reduced to a size which would result in the developing slope surface extending above the lowermost edge of the respective intake port, a vertical extention plate can be provided. The vertical extension plate has no influence on the predetermined proportional amount of the bulk goods passing through the respective intake port while reliably preventing any backup of the material flow.

Embodiments featuring vertically adjacent intake ports offset relative to one another by an a circumferential angle of 120° or 180° have been found to be particularly suitable in practical use.

Depending on the desired flow rate, two or more intake ports may be provided at the same level, in which case the sum of the proportional amounts of the bulk goods withdrawn at the given level is determined by the sum of the parts of the cross-sectional area obturated by the associated deflector baffles. In this embodiment the intake ports may be disposed at exactly the same level or with a slight vertical offset if so required for structural strength considerations.

Smooth withdrawal of the bulk goods from the outer container may be achieved by an embodiment featuring an outer container having a funnel-shaped bottom wall portion formed with an outlet opening surrounding an outlet port of the mixing pipe so as to define an annular outlet passage.

The withdrawal of the bulk goods from the mixing bin as a whole is facilitated when the lower end of the mixing pipe is provided with a funnel-shaped wall portion defining the outlet port.

To ensure that a greater proportion of the bulk goods is withdrawn through the mixing pipe, the cross-sectional area of the annular outlet passage may be made smaller than the cross-sectional area of the outlet port of the mixing pipe. These provisions are effective to achieve a broad residence time distribution, resulting in a good mixing effect.

The inclinations of all funnel walls are preferably selected to improve the flow of the bulk goods and to avoid the formation of dead zones.

The mixing result is further improved where the flow rate of the bulk goods in the outlet port of the mixing pipe is higher than the flow rate of the bulk goods in the outer container. Embodiments featuring deflector baffles of planar or curved, particularly conical, configurations have been found to be useful. Alternative constructions include deflector baffles formed by inwardly bent wall portions of the mixing pipe or guided and retained in previously sawn or milled slots. Positioning a deflector cone above the uppermost intake port so as to obturate the entire cross-sectional area of the mixing pipe ensures that the mixing pipe is filled only through the intake ports formed in its walls. Particular embodiments may include a mixing pipe of circular or polygonal cross-section.

It is a further object of the invention to provide a mixing pipe which can be manufactured in a particularly simple and cost-effective manner, such as through the use of a mixing pipe assembled of folded profile members or extruded members.

The provision of a neck portion of the outer container roof having an inner width greater than or equal to an outer width of the mixing pipe is effective to decisively facilitate the assembly of the mixing bin, because this construction permits the mixing pipe to be lowered into the outer container directly through its roof.

In one embodiment, the mixing pipe may be supported by struts projecting from the bottom portion of the outer container. In another embodiment, the mixing pipe may be suspended from the roof of the outer container and merely guided in the lower portion of the outer container. The outer container and mixing pipe may be made of an aluminum alloy, with all connections being welded. In another embodiment, the mixing pipe may be made of stainless steel and connected to an aluminum outer container with adhesive, threaded or riveted connections.

Figure 2:
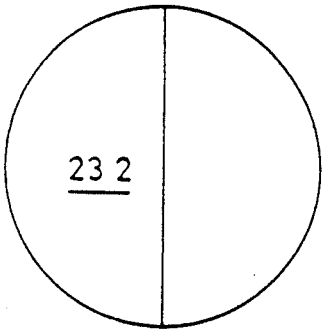
Figure 3:
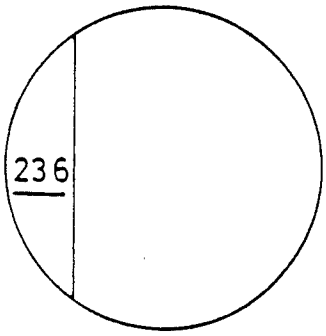
Figure 4:
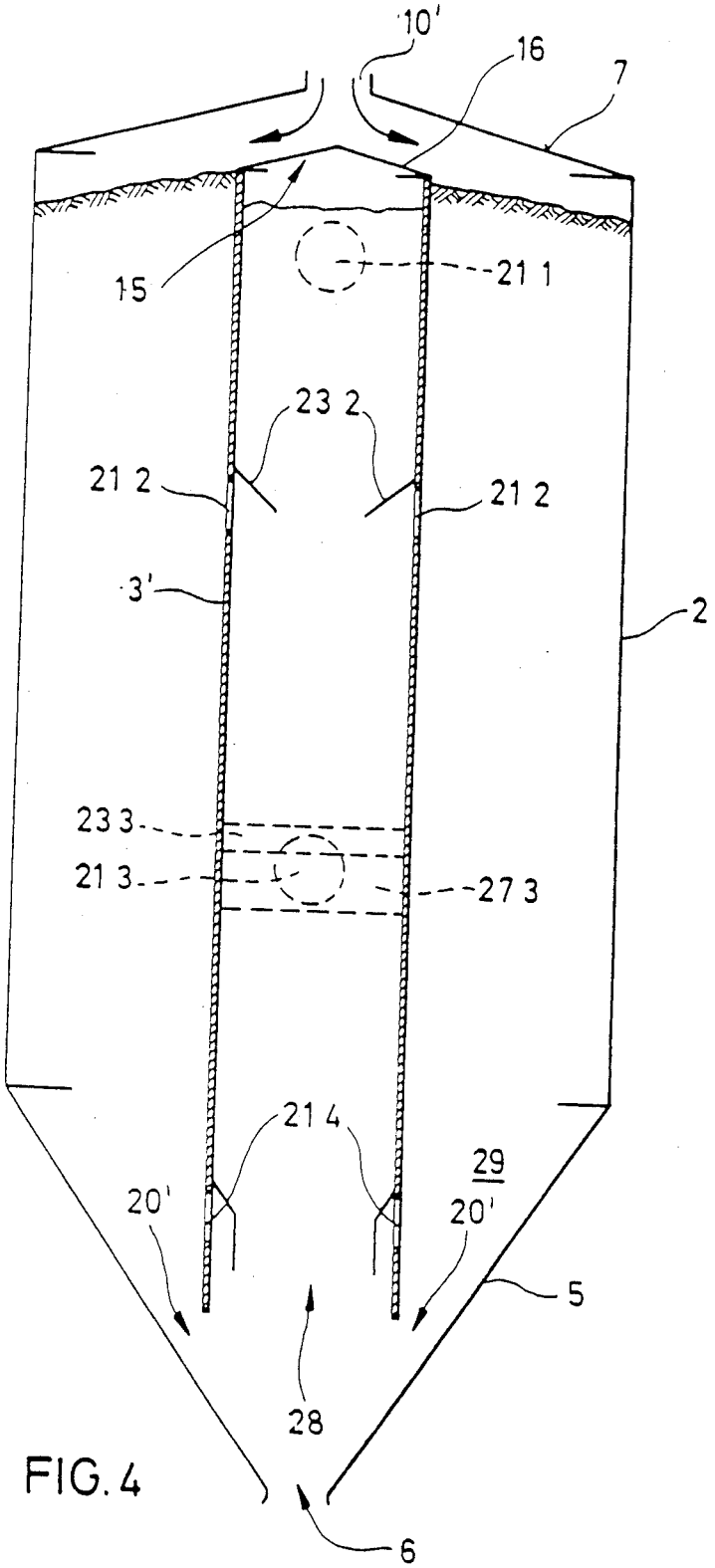

Embodiments of the invention shall now be described in detail by way of example with reference to the accompanying drawings, wherein:

FIG. 1 shows a diagrammatic axial section through a mixing bin according to a first embodiment of the invention, FIG. 2 shows a section taken at II—II in FIG. 1, FIG. 3 shows a section taken at III—III in FIG. 1, and FIG. 4 shows a diagrammatic axial section through a mixing bin according to another embodiment of the invention.

Shown in FIG. 1 is a diagrammatic illustration of a mixing bin 1 composed of an outer container 2 and a mixing pipe 3 mounted coaxially within outer container 2 and having a smaller cross-sectional area than container 2. Outer container 2 has a cylindrical sidewall 4 and a funnel-shaped bottom portion 5 having its lower end provided with an outlet opening 6 in coaxial alignment with the container axis. Bottom portion 5 is divided into two sections having different sidewall inclination angles for thereby reducing the overall construction height. The upper end of outer container 2 is closed by a roof 7 having a tubular neck portion 8 inserted therein in coaxial alignment with the container axis. The inner diameter of neck portion 8 is greater than or at least equal to the outer diameter of mixing pipe 3, so that the latter can be inserted through neck portion 8 for assembly. The upper end of neck portion 8 is closed by a cover 9 having a neck portion 10 of a smaller diameter extending therethrough in coaxial alignment with the container axis and connected to means for filling outer container 2.

Mixing pipe 3 is provided with struts 11 extending upwards into first neck portion 8. Mixing pipe 3 is additionally supported on the inner wall surface of outer container 2 at the juncture of its cylindrical sidewall 4 and funnel-shaped bottom portion 5 by radially extending struts 12. Although only one strut 12 is shown, there may be a plurality of such struts disposed at equal spacings in the circumferential direction. In the embodiment shown, mixing pipe 3 is integrally connected to struts 12, the latter being welded to outer container 2. Struts 11 are in loose surface contact with the inner wall surface of first neck portion 8 for centering and laterally supporting mixing pipe 3. It is also possible, however, to suspend mixing pipe 3 from neck portion 8 or directly from roof 7 by struts 11 or equivalent components, for instance an extension of mixing pipe 3. In this case the lower portion of mixing pipe 3 would only require suitable guide means instead of the struts 12 integrally connected thereto.

Mixing pipe 3 and outer container 2 are preferably made of an aluminum alloy, the various connections being formed as welded connections. It is also possible, however, to employ stainless steel for the mixing pipe and aluminum for the outer container, in which case these two main components would be interconnected by adhesive, threaded or riveted connections.

Mixing pipe 3 encloses an interior space 14 of constant circular cross-section over the major part of its height. It is also conceivable, however, to employ different cross-sectional shapes, for instance a polygonal shape, particularly when mixing pipe 3 is composed of a plurality of components to facilitate assembly of the apparatus. The individual components may then be formed by folded profile members or extrusions.

Mixing pipe 3 has an upper opening 15 facing towards filling neck portion 10 and covered by a conical deflector cover 16, so that the bulk goods supplied to neck portion 10 is prevented from dropping directly into mixing pipe 3. On the underside of deflector cover 16 there is preferably provided a flushing nozzle 17 connected to an exterior conduit for the supply of a flushing liquid. This permits the interior of mixing pipe 3 to be cleaned in a simple manner. The lower end portion of mixing pipe 3 is formed as a funnel 18 terminating in an outlet port 19. Funnel 18 extends downwards to a location within bottom portion 5 so as to define a conically converging annular space 29 therebetween. As a result, outlet port 19 of funnel 18 is surrounded by an annular outlet opening 20 for the passage therethrough of bulk goods contained in outer container 2. Outlet port 19 of mixing pipe 3 and outlet opening 6 of funnel-shaped bottom portion 5 are disposed in coaxial alignment with one another. The cross-sectional area of outlet port 19 is greater, however, than the cross-sectional area of annular outlet opening 20 at the level of outlet port 19, so that a greater amount of bulk goods is recovered from mixing pipe 3 than from outer container 2. The inclination of the walls of both funnel 18 and funnel-shaped bottom portion 5 is selected to ensure mass flow conditions both within mixing pipe 3 and in annular passage 29 with a substantially uniform flow rate over the respective cross-sectional areas, so that the formation of stagnant zones is avoided. The configuration of funnel 18 may additionally be selected so as to result in a higher flow rate within mixing pipe 3. Outlet opening 6 has the smallest cross-sectional area of all existing outlet ports and openings 6, 19 and 20, respectively, its dimensions being selected so as to guard against any bridging effect, thus precluding the occurrence of a bridging effect at any of the other ports and openings.

At different levels above funnel 18, mixing pipe 3 is formed with a plurality of intake ports 21 opening through its sidewall, FIG. 1 illustrating only intake ports 211 to 216 located at diametrally opposite positions for better understanding. Intake ports 211 to 216 may be round, triangular, rectangular or of parabolic shape. The size of intake ports 211 to 216 is of no importance with regard to the amount of bulk goods to be withdrawn therethrough, and is suitably selected so as to guard against the occurrence of a bridging effect upstream of the ports, i.e. outside of mixing pipe 3. The uppermost first intake port 211 is located adjacent deflector cover 16 just below the maximum filling level 22 of outer container 2. The second to sixth intake ports 212 to 216 are disposed at predetermined spacings downwards thereof at levels corresponding to the bulk good layers in outer container 2 to be tapped. Beginning with the second intake port 212 from above, each intake port 21 has a respective deflector baffle 232 to 236 disposed thereabove. As shown in FIGS. 2 and 3, each deflector baffle 232 to 236 has the shape of a cone wall section and is inserted into a previously formed-for instance sawn or milled-slot in the wall of mixing pipe 3 so as to extend obliquely downwards at an angle of 20° to 45° relative to the vertical into the interior space 14 of mixing pipe 3. Deflector baffles 232 to 236 are of different sizes. In the present example mixing bin 1 is designed so that the same proportional amount of bulk goods enters the interior space 14 of mixing pipe 3 through all of intake ports 211 to 216. To this purpose, the size of deflector baffles 232 to 236, and thus the respective parts of the cross-sectional area of mixing pipe 3 obturated by them, decreases from top to bottom in accordance with the following formula:

$$A = \frac{F}{n + 1}$$

wherein

A is the part of the cross-sectional area of the mixing pipe obturated by the respective deflector baffle, F is the total cross-sectional area of the interior space of the mixing pipe, and n is the number of intake ports disposed above the respective deflector baffle.

In accordance with this formula, the deflector baffle 232 of the second intake port 212 from above should thus obturate one-half of the total cross-ectional area of mixing pipe 3.

$$\left(\frac{F}{1+1}\right).$$

The deflector baffle 233 of the third intake port 213 from above should then obturate one third $$\left(\frac{F}{2+1}\right)$$

of the total cross-sectional area, the deflector baffle 234 of the fourth intake port 214 from above one fourth, the deflector baffle 235 of the fifth intake port 215 from above one-fifth, and the deflector baffle 236 of the sixth intake port 216 from above one-sixth of the total cross-sectional area, to thereby ensure that the same proportional amount of the bulk goods enters mixing pipe 3 and thus funnel 18 through all intake ports 211 to 216. These relationships are more clearly evident from FIGS. 2 and 3 showing respectively a top plan view of the first and sixth deflector baffles, the other components having been omitted for clarity. It shall be assumed that mixing bin 1 has been filled with bulk goods as indicated by arrows A in FIG. 1 up to the filling level 24 in outer container 2, with outlet opening 6 closed. Due to the location of the uppermost edge of first intake port 211 below filling level 24 of outer container 2, the filling level 25 attained within mixing pipe 3 will be somewhat lower. When outlet opening 6 is now opened, the bulk goods columns contained in outer container 2 and in mixing pipe 3 will start to slide downwards. At this stage the deflector baffles 232 to 236 disposed above the individual intake ports 211 to 216 prevent the descent of that part of the bulk goods column located in mixing pipe 3 directly above the respective intake port, so that bulk goods can enter mixing pipe 3 at this location from outside, i.e. from the column in outer container 2. As a result of the varying dimensions, the bulk goods flow in funnel 18 will have the following composition: At the level of uppermost intake port 211, all of the bulk goods in interior space 14 is provenient from the uppermost layer of the bulk goods column in outer container 2. As shown in FIG. 2, however, the deflector baffle 232 of the second intake port 212 from above reduces the passage available for the flow of this bulk goods proportion to one-half of the cross-sectional area of interior space 14, while permitting another amount of bulk goods to enter mixing pipe 3 through second intake port 212 so as to occupy the other half of the cross-sectional area of interior space 14. At the level of deflector baffle 233 the bulk goods flow is thus composed of substantially equal amounts of bulk goods having entered through intake ports 211 and 212, respectively. Deflector baffle 233 reduces the passage available for the flow of this bulk goods composition to two thirds of the cross-sectional area of mixing pipe 3 while permitting a further amount of bulk goods to enter through intake port 213 so as to occupy the remaining third of the interior space 14. This principle continues down to the sixth intake opening 216, whereat five-sixths of the total cross-sectional area is available for the passage of the equal proportional bulk goods amounts from the upper five intake ports, while one-sixth of the cross-sectional area is available for the bulk goods entering through sixth intake port 216. The mixture descending into funnel 18 is thus composed of substantially equal proportional amounts, i.e. of one-sixth each of the bulk goods having entered through each of the six intake ports 21. At the level of outlet port 19, the bulk goods flows from funnel 18 and annular passage 29 are joined. The bulk goods flow discharged through outlet opening 6 is thus composed of proportional amounts of bulk goods withdrawn at the respective levels of intake ports 211 to 216 and at the level of funnel-shaped bottom portion 5.

In order to prevent the bulk goods column enclosed in interior space 14 from encroaching the vicinity of the second to sixth intake ports 212 to 216 and from thereby hampering the entrance of bulk goods from outer container 2 at these locations, deflector baffles 23 are suitably extended downwards to such a level that a theoretically forming slope surface 26 remains clear of the lowermost edge of the associated intake port, as indicated by a dotted line in FIG. 1. The larger deflector baffles required for the upper intake ports are by themselves capable of satisfying this condition. As the deflector baffles are getting smaller, however, so that they even terminate above the lowermost edge of the associated intake ports, they are provided with an extension plates 274 to 276 extending from the free edge of the respective deflector baffle 234 to 236, respectively. Each extension plate 274 to 276 extends vertically downwards substantially parallel to the direction of flow of the bulk goods in the interior space 14, so that its surface does not influence the proportional composition of the bulk goods flow. Each extension plate 274 to 276 terminates at a level whereat the slope surface forming at its free end extends below the associated intake port 214 to 216. Depending on the flow properties of the bulk goods and the slope angles resulting therefrom, the free ends of deflector baffles 232 to 236 or extension plates 274 to 276, respectively, may extend at or below the level of the lowermost edge of the associated intake port 211 to 216, or in the case of very steep slope angles, even slightly above this level.

FIG. 4 shows a modification of the mixing bin 1 according to the invention, similar or equivalent components of this embodiment being designated by the same reference numerals and not described again. Mixing bin 1 of FIG. 4 likewise comprises an outer container 2 having a cylindrical sidewall 4 and a funnel-shaped bottom portion 5 with an outlet opening 6. The container is filled through a neck portion 10' directly connected to roof 7. A modified mixing pipe 3' has its upper and lower ends provided with respective openings of a size corresponding to its cross-sectional area, the upper opening 15 being again completely closed by a conical deflector cover 16. The lower outlet opening 28 is again located in funnel-shaped bottom portion 5 to define therewith an annular passage 20' of an even smaller size than in the embodiment of FIG. 1. The most important modification, however, is the arrangement of the intake ports, which may otherwise be of the same type and configuration as in the embodiment of FIG. 1. In the modification of FIG. 4, groups of two intake ports 211 to 216 are provided at each or any level. The intake ports 211 to 216 of each pair are disposed at diametrally opposite locations, the pairs of intake openings 211 to 216 at different levels being offset relative to one another by a circumferential angle of 90°. The size of deflector baffles 232 to 236 is again determined in accordance with the formula explained with reference to the embodiment of FIG. 1, with the provision that in this case A is the sum of all parts of the total cross-sectional area obturated by all of the deflector baffles at any given level.

In all embodiments of the invention, the deflector baffles with or without associated extension plates may also be formed by suitably cutting the wall of the mixing pipe and deforming the cut-out portion inwards. It is also possible to vary the configuration of the deflector baffles. The planar deflector sheets described and depicted in the drawings may thus be replaced by curved sheet members, particularly of conical section. The arrangement of the intake ports may likewise be varied. It is thus for instance absolutely possible to form the intake ports at vertically adjacent levels at positions offset by an angle of 120° or 90° or any other angle relative to one another. If so required it is also possible to provide more than two intake ports at uniform circumferential spacings at the same level, in which case the associated deflector baffles are to be dimensioned in the manner already stated above. It is of course also possible to give preference to a particular layer of the bulk goods in the mixing operation by dimensioning the deflector baffle or baffles associated with the intake port or ports of the respective level greater than would be required for a proportionally equal intake. In this manner it is possible to preselect practically any desired proportional composition of the resultant mixture. It is further possible to form the first or uppermost intake port in for instance the deflector cover, in which case the uppermost intake port formed in the mixing pipe sidewall will have to be provided with a deflector baffle. The position of the neck portions, and if need be also the position of the mixing pipe relative to the center axis of the outer container may also be varied in accordance with practical requirements, for instance space requirements.

I claim:

1. A mixing bin for mixing bulk goods by gravity flow, comprising an outer container having a bottom provided with an outlet and a mixing pipe disposed substantially centrally in said outer container, said mixing pipe being provided with a plurality of intake ports disposed at different levels above said bottom for withdrawing bulk goods at said different levels from a bulk goods column contained in said outer container, all of said intake ports opening into a common interior space of said mixing pipe, said interior space having a cross-sectional area at each of said intake ports to be passed by the bulk goods within said interior space, a deflector baffle being disposed above each of said intake ports, projecting into said interior space and obturating a part of said cross-sectional area of said interior space, the parts of said cross-sectional area of said interior space obturated by respective ones of said deflector baffles disposed at said different levels above said bottom being of different size, and the size of the obturated part of said cross-sectional area at each level above said bottom being selected such that a desired amount of bulk goods is withdrawn through the associated intake port.

2. A mixing bin for mixing bulk goods by pure gravity flow, comprising an outer container having a bottom provided with an outlet and a mixing pipe disposed substantially centrally in said outer container, said mixing pipe being provided with a plurality of intake ports disposed at different levels above said bottom for withdrawing bulk goods at said different levels from a bulk goods column contained in said outer container, all of said intake ports opening into a common interior space of said mixing pipe, said interior space having a cross-sectional area at each of said intake ports to be passed by the bulk goods within said interior space, a deflector baffle being disposed above each of said intake ports, projecting into said interior space and obturating a part of said cross-sectional area of said interior space, the parts of said cross-sectional area of said interior space obturated by respective ones of said deflector baffles disposed at said different levels above said bottom being of different size, and the size of the obturated part of said cross-sectional area at each level above said bottom being selected such that a desired amount of bulk goods is withdrawn through the associated intake port.

3. A mixing bin according to claim 1, wherein the deflector baffle associated with one of said intake ports to be passed by the bulk goods flow in said interior space obturates a part of said cross-sectional area determined by dividing the cross-sectional area of said mixing pipe by the number of intake ports disposed at higher levels than said one of said intake ports plus one, such that a substantially equal amount of bulk goods is withdrawn through each of said intake ports.

4. A mixing bin according to claim 1 or 3, wherein said deflector baffles are inclined inwards and downwards.

5. A mixing bin according to claim 4, wherein said deflector baffles have an angle of inclination of 20° to 45° with respect to the vertical.

6. A mixing bin according to claim 1, wherein each deflector baffle extends downward to such a level that the slope surface formed by the bulk goods withdrawn though said intake ports at higher levels is located below a lowermost edge of the associated intake port.

7. A mixing bin according to claim 6, wherein each deflector baffle extends to a level below the lowermost edge of the associated intake port.

8. A mixing bin according to claim 7, wherein at least one of said deflector baffles is provided with an extension plate extending substantially vertically downwards from a free edge of said deflector baffle extending into the interior space of said mixing pipe.

9. A mixing bin according to claim 1, wherein vertically adjacent intake ports are offset relative to one another by a circumferential angle of 120°.

10. A mixing bin according to claim 1, wherein vertically adjacent intake ports are offset relative to one another by a circumferential angle of 180°.

11. A mixing bin according to claim 1, wherein a plurality of intake ports are provided at the same level, said intake parts being disposed circumferentially around said mixing pipe at equal spacings and the amount of bulk goods to be withdrawn through said intake ports being determined by the sum of said parts of the cross-sectional area of said mixing pipe obturated by said deflector baffles associated with said intake ports.

12. A mixing bin according to claim 1, wherein said outer container has a funnel-shaped bottom wall portion formed with an outlet opening surrounding an outlet port of said mixing pipe so as to define an annular outlet passage.

13. A mixing bin according to claim 12, wherein the lower end of said mixing pipe is provided with a funnel-shaped wall portion defining said outlet port.

14. A mixing bin according to claim 12, wherein said annular outlet passage has a smaller cross-sectional area than said outlet port of said mixing pipe.

15. A mixing bin according to claim 13, whrein the inclination of all funnel-shaped wall portions is selected to achieve desired mass flow requirements.

16. A mixing bin according to claim 13, wherein the bulk goods in said funnel-shaped wall portion of said mixing pipe have a higher flow rate than in said outer container.

17. A mixing bin according to claim 1, further comprising a deflector cone positioned above the uppermost intake port so as to obturate the entire cross-sectional area of said mixing pipe and to prevent said mixing pipe from being filled from above in the axial direction.

18. A mixing bin according to claim 1, wherein said outer container further comprises a roof having a neck portion and an inner width greater than or equal to an outer width of said mixing pipe.

19. A mixing bin according to claim 1, wherein said mixing pipe is supported by a plurality of struts projecting from said outer container.

20. A mixing bin according to claim 18, wherein said mixing pipe is suspended from said roof of said outer container.

* * * * *